United States Patent [19]

Blidung et al.

[11] Patent Number: 4,650,453

[45] Date of Patent: Mar. 17, 1987

[54] APPARATUS FOR CROSS CUTTING A RUNNING WEB

[75] Inventors: Otto Blidung, Geesthacht; Dieter Schwenke, Hamburg, both of Fed. Rep. of Germany

[73] Assignee: Womako Maschinenkonstruktionen GmbH, Nürtingen, Fed. Rep. of Germany

[21] Appl. No.: 772,641

[22] Filed: Sep. 5, 1985

[30] Foreign Application Priority Data

Sep. 26, 1984 [DE] Fed. Rep. of Germany ..... 3435212

[51] Int. Cl.[4] ..... B65B 11/16

[52] U.S. Cl. ..... 493/239; 53/389; 83/24; 83/100; 493/369

[58] Field of Search ..... 53/389; 83/24, 98, 99, 83/100; 493/239, 369

[56] References Cited

U.S. PATENT DOCUMENTS

| | | | |
|---|---|---|---|
| 3,385,026 | 5/1968 | Schmermund | 53/389 X |
| 3,982,375 | 9/1976 | Focke | 53/389 X |
| 4,151,699 | 5/1979 | Focke et al. | 83/100 X |
| 4,300,893 | 11/1981 | Achelpohl et al. | 493/206 X |
| 4,385,479 | 5/1983 | Focke | 53/389 |
| 4,495,746 | 1/1985 | Focke et al. | 83/100 X |

*Primary Examiner*—James F. Coan

*Attorney, Agent, or Firm*—Peter K. Kontler

[57] ABSTRACT

A flexible web which is caused to run through a cross cutter to be severed at regular intervals in order to yield a series of discrete sections is engaged by a pair of holders which attract the web by suction immediately behind the severing plane when the cutter severs the web. The holders advance with the web and thereafter with the freshly formed section to prevent changes in orientation of the sections on their way to a removing station where they are expelled from the path of the web by block-shaped commodities which are draped into the respective sections. The surfaces of the holders are small and the length of each holder is a minute fraction of the length of a section, as considered in the longitudinal direction of the web. The holders are mounted on endless toothed belt or chain conveyors which advance the holders along an endless path having an elongated reach extending adjacent to the path of movement of the web and its sections toward, past and beyond the severing station.

20 Claims, 7 Drawing Figures

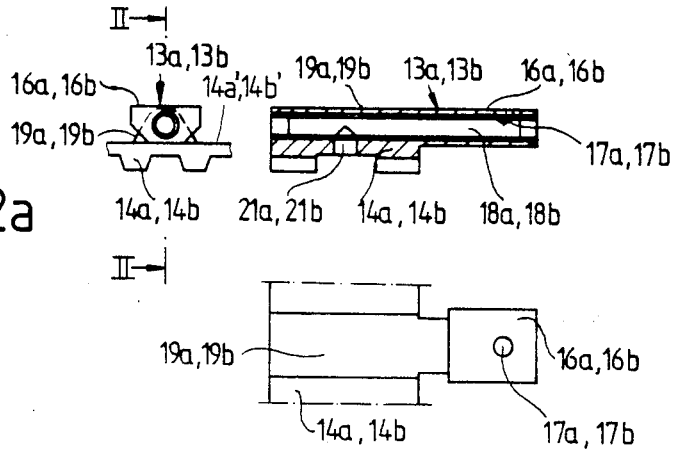
Fig.2a
Fig.2b
Fig.2c
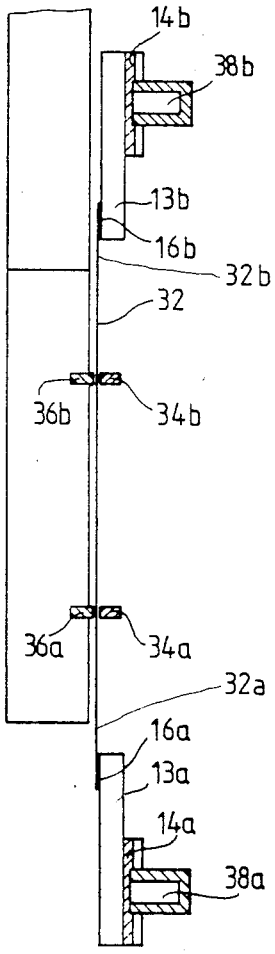
Fig. 3

APPARATUS FOR CROSS CUTTING A RUNNING WEB

BACKGROUND OF THE INVENTION

The present invention relates to apparatus for converting a running web of paper, metallic foil, plastic foil or the like into a series of sheet-like sections, e.g., into blanks which are to be converted into the wrappers of block-shaped or otherwise configurated commodities. More particularly, the invention relates to improvements in apparatus for repeatedly severing the leader of a running web at right angles or substantially at right angles to the longitudinal direction of the web, e.g., by means of one or more orbiting knives or other suitable cutting implements.

Accurate guidance of sections from a severing station to the next processing station presents serious problems in modern cross cutters which are designed to sever the running web at a high frequency. If the sections are advanced in haphazard fashion, each section which arrives at the next processing station must be accurately oriented prior to contacting the commodity which is to be draped into the section; otherwise, the appearance of the wrapper will be unacceptable to the purchaser. Even minor deviations from an optimum orientation of sheet-like sections are readily detectable when such sections are converted into parallelepiped wrappers or the like, especially if the sections carry printed matter. The situation is aggravated if the cross cutter is designed to sever readily flexible webs, e.g., webs or strips which consist of thin plastic foil and which can be flexed by slight currents of air.

Attempts to guide readily flexible sheet-like sections from the station where a running web is severed by the knife or knives of a cross cutter include the utilization of a pair of endless belt conveyors with neighboring reaches which confine the freshly severed sections and advance them to the next processing station. Such proposal is not entirely satisfactory because a highly flexible section cannot be readily separated from the reaches of the belts on arrival at the next processing station. It has been found that predictable separation of sections from the belt conveyors involves extremely high expenditures in equipment without guaranteeing predictable separation when the sections are to be transported at a high frequency.

OBJECTS AND SUMMARY OF THE INVENTION

An object of the invention is to provide a novel and improved apparatus wherein successive sections of a running web can be transported from the severing station to the next processing station with simple, compact and inexpensive equipment and with a high degree of accuracy and reproducibility irrespective of the frequency at which the cross cutter severs the running web.

Another object of the invention is to provide the apparatus with novel and improved means for retaining the running web in its prescribed path.

A further object of the invention is to provide novel and improved means for retaining successively severed discrete sections of the web in their prescribed path.

An additional object of the invention is to provide the apparatus with novel and improved means for retaining the web and succesively severed sections in their prescribed path or paths.

Still another object of the invention is to provide an apparatus wherein the web and its sections can be guided with a high degree of accuracy regardless of the flexibility of the web material and irrespective of the frequency at which the cross cutter severs the leader of the web.

A further object of the invention is to provide the apparatus with novel and improved means for preventing currents of air and/or other influences from affecting the accuracy of guidance of the running web and its sections along a prescribed path, even if the resistance of the web to flexing is negligible.

An additional object of the invention is to provide a novel and improved method of guiding a running web and its sections on the way toward, past and beyond the severing station.

Another object of the invention is to provide a machine which embodies the above outlined apparatus.

One feature of the invention resides in the provision of an apparatus for converting a running web (e.g., a continous thin strip of highly flexible synthetic plastic material which may but need not transmit light) into a series of discrete sections, e.g., into a series of rectangular or square blanks which can be draped around block-shaped commodities such as stacks of stationery products or the like. The apparatus comprises means for advancing the web longitudinally in a predetermined direction and along a predetermined path and a cross cutter or other suitable means for severing the leader of the web at selected intervals in a first portion of the path so that the web yields the aforementioned series of discrete sections each of which has two sides or major surfaces of predetermined area. The severing means includes at least one cutter which is arranged to sever the web transversely of the predetermined direction in a predetermined severing plane, and the apparatus further comprises means for retaining the web and the sections in the path, including at least one holder having a contact surface whose area is preferably a small or minute fraction of the predetermined area and which engages the web close to and upstream of the severing plane, as considered in the predetermined direction, when the web is being severed by the cutter. The apparatus further comprises conveyor means for transporting the holder in the predetermined direction adjacent to the predetermined path so that the holder first advances the leader of the web toward the severing plane and the same holder thereupon advances the freshly severed section from the first portion toward and into a second portion of the predetermined path.

The cutter is preferably arranged to subdivide the web into sections each of which has a predetermined length, as considered in the predetermined direction, and the length of the surface of the holder (as considered in the predetermined direction) is preferably less than ten percent of the predetermined length. The holder can include means for attracting the web and the sections by suction. Still further, the apparatus can comprise means for separating the holder from the adjacent section in the second portion of the predetermined path; such separating means preferably includes means for moving the section in the second portion of the path transversely of the predetermined direction. The separating means can include means for directing at least one jet of compressed gaseous fluid (e.g., air) against the section which has entered the second portion of the predetermined path. The jet is caused to flow in a direction to separate the section from the surface of the holder.

The conveyor means preferably defines for the retaining means a second path having an elongated stretch or reach which is adjacent to the predetermined path in a region extending from a first location at least slightly upstream of the first portion to a second location at or downstream of the second portion of the predetermined path. The just mentioned stretch is adjacent to one side of the predetermined path so that the surface of the holder can engage one side of the web and the corresponding side of the section which is advanced by the holder from the first toward the second portion of the predetermined path. The retaining means preferably comprises first and second holders each of which is adjacent to and engages a different longitudinally extending marginal portion of the web on its way toward the severing plane. The conveyor means can include at least one endless flexible conveyor having a surface which faces toward the retaining means and is parallel or nearly parallel to the surface of the holder.

The apparatus preferably further comprises guide means for portions of successive sections between the first and second portions of the predetermined path. The conveyor means is arranged to advance the retainer means past the guide means, i.e., the retainer means can bypass the normally stationary guide means.

The apparatus can also comprise second retaining means for holding at least one side of each section between the first and second portions of the predetermined path while the holder or holders of the first mentioned retaining means contact the other side of the same section. The second retaining means can comprise at least one pair of cooperating clamping members which are disposed at the opposite sides of the section advancing from the first to the second portion of the predetermined path.

The predetermined path is or can be vertical, and the first retaining means preferably comprises several pairs of equidistant holders which can act not unlike suction cups. The normally stationary guide means is or are located between those pairs of holders which are adjacent to the predetermined path.

Another feature of the invention resides in the provision of a method of converting a running web of paper, metallic foil, plastic foil or the like into a series of discrete sections. The method comprises the steps of advancing the web longitudinally in a predetermined direction and along a predetermined path, severing the web at selected intervals in a first portion of the path so that the web yields the series of discrete sections each of which has two sides of a predetermined area (the severing step includes cutting across the web in a predetermined plane), retaining the web and the sections in the path, including mechanically contacting and holding one side of the web in close or immediate proximity to and upstream of the severing plane in the course of each severing step (the area of mechanical contact with the one side of the web in the course of each severing step is a minute fraction (e.g., less than one percent) of the area of one side of a section), and expelling successive sections from a second portion of the path.

The retaining step can include attracting the web and the sections by suction so that the sections are held against unintended changes in orientation all the way during travel (as portions of the web or as discrete sections) from the first to the second portion of the path.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

FIG. 2*a* is a side elevational view of a holder;

FIG. 2*b* is a sectional view of the holder as seen in the direction of arrows from the line II—II of FIG. 2*a;*

FIG. 2*c* is a plan view of the holder;

FIG. 3 is a sectional view as seen in the direction of arrows from the line III—III of FIG. 1;

DESCRIPTION OF THE PREFERRED EMBODIMENTS

Figure 1:
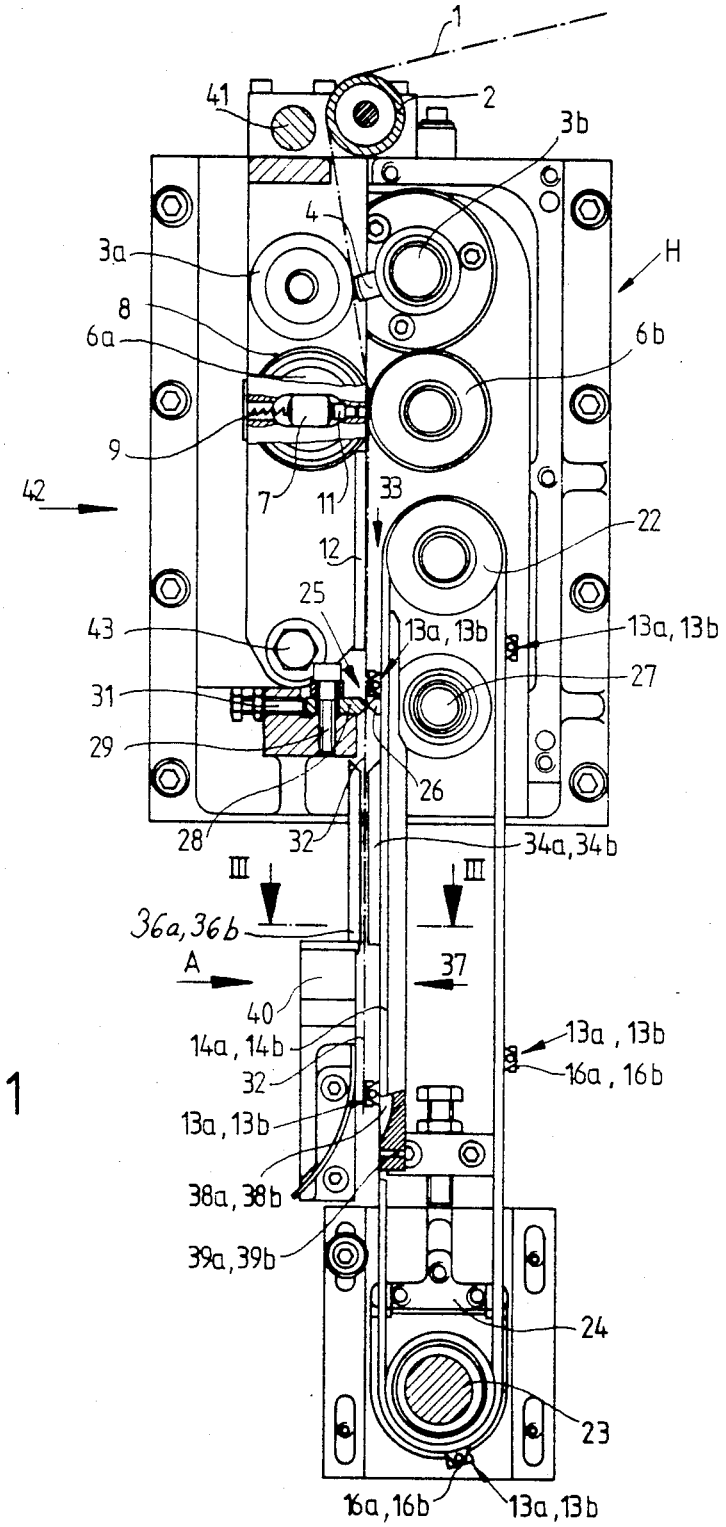
FIG. 1 is an elevational view of an apparatus which embodies one form of the present invention, certain parts of the apparatus being shown in vertical section.

FIG. 1 shows an apparatus which serves to convert the leader of a continuous running web 1 (indicated by a phantom line) into a series of discrete square or rectangular sections or sheets 32. The path for the web 1 and sections 32 is defined in part by a deflecting roller 2 which can constitute an idler and is mounted at the top of the housing H for two web advancing wheels 6*a*, 6*b* which are disposed at the opposite sides of the path for the web 1 and one of which (e.g., the wheel 6*b*) is driven to advance the web 1 in the direction which is indicated by the arrow 33. A portion of the path for the web 1 is further defined by two rollers 3*a*, 3*b* which are mounted in the housing H upstream of the web advancing wheels 6*a*, 6*b* and one of which carries an orbiting knife 4 serving to form in the running web 1 longitudinal and/or transverse slits or cuts without actually cutting all the way across the web. The roller 3*b* for the knife 4 can be driven at an RPM such that each section 32 is formed with a slit. The roller 3*a* is a counterknife.

The web advancing wheel 6*a* includes a shaft 7 for a sleeve 8 of elastomeric material. The shaft 7 is biased in a direction toward the driven shaft of the advancing wheel 6*b* by a suitable spring 9 or a set of springs. One or more stops 11 are provided to limit the extent of sidewise movement of the shaft 7 and the sleeve 8 thereon toward the driven wheel 6*b* and to thus prevent pulling.

The housing H further supports an elongated guide 12 along which the web 1 advances beyond the nip of the web advancing wheels 6*a*, 6*b* and on toward the severing station 25 for a cross cutter. The guide 12 steers the leader of the web 1 into the range of pairs of finger-like holders 13*a*, 13*b* which extend at right angles to the plane of FIG. 1 and constitute elements of a means for retaining the web 1 and the sections 32 in their prescribed path during travel of successive increments of the web 1 toward the severing station 25 as well as during travel of successively formed sections 32 from the severing station 25 to a second portion of the path where the sections 32 are expelled from such path by being moved to the left, as viewed in FIG. 1 and as indicated by the arrow 37. The holders 13*a*, 13*b* are mounted on endless flexible toothed belt conveyors 14*a*, 14*b* having vertical stretches or reaches which are adjacent to the path for the web 1 and successive sections 32 between that portion (station 25) of such path which accommodates the cross cutter and the portion (station A) where the sections 32 are expelled in the direction of the arrow 37. The path which is defined by the conveyors 14*a*, 14*b* for the respective holders 13*a*, 13*b* is adjacent to the longitudinally extending marginal portions of the web 1 and sections 32 (see FIG. 3).

FIGS. 2*a*, 2*b* and 2*c* show the details of one of the holders and of the adjacent portion of the corresponding endless toothed belt conveyor. Each of the holders 13*a*, 13*b* has a flat surface 16*a*, 16*b* provided with at least one suction port (17*a*, 17*b*). The suction ports are free to communicate, at times, with a suction generating device (not shown) by way of channels 18*a*, 18*b* which are machined into or otherwise formed in ribs 19*a*, 19*b* on the conveyors 14*a*, 14*b*. The conveyors 14*a*, 14*b* respectively have channels 21*a*, 21*b* which communicate with the corresponding channels 18*a*, 18*b* and are in communication, during selected stages of travel along their respective endless paths, with the suction generating device. The conveyors 14*a*, 14*b* are trained over toothed pulleys 22 and 23. The pulley 22 is driven by the main prime mover of the apparatus. The conveyors 14*a*, 14*b* are tensioned by a tensioning device 24 which is installed in the lower portion of the housing H, as viewed in FIG. 1.

The cross cutter at the severing station 25 includes an orbiting knife or cutter 26 which is mounted on and receives motion from a rotary drum-shaped knife holder 27. The edge of the cutter 26 cooperates with a stationary counterknife 28 whose position (actually its distance from the path of movement of the edge of the knife or cutter 26) is adjustable by a first screw 31 subsequent to loosening of a second screw 29 which fixes the counterknife 28 to the adjacent portion of the housing H. The edge of the cutter 26 cuts across the leader of the web 1 in a severing plane which is normal to the plane of FIG. 1 and extends transversely of the web.

The kinematic relationship between the cutter 26 and successive pairs of holders 13*a*, 13*b* of the retaining means is selected in such a way that the holders (which attract one side of the leader of the web 1) are located immediately behind the aforementioned severing plane when the edge of the cutter severs the web 1 in order to form a fresh section 32. The holders 13*a*, 13*b* then advance with the remainder of the web 1 in the direction which is indicated by the arrow 33 and are located at the foremost (lowermost) end of the leader when the web 1 is severed again. The holders 13*a*, 13*b* continue to attract the freshly severed section 32 and move it toward the second portion of the vertical path for the web 1 and sections 32 so that the foremost portion of each freshly formed section 32 is pulled or drawn from the station 25 (first portion of the predetermined path) toward the second portion (station A) of such path. It will be seen that, whenever the cutter 26 severs the web 1, two holders 13*a*, 13*b* attract one side of the web 1 immediately upstream of the severing plane and the preceding holders 13*a*, 13*b* attract the corresponding side of the foremost or lowermost part of the web so that such foremost or lowermost part of the web cannot be flexed by currents of air or for any other reasons, even if the web is transported at a high speed, i.e., even if the cutter 26 severs the web at a high frequency. It has been found that the improved apparatus can properly form and advance sections 32 which are severed from a highly flexible web 1 consisting of extremely thin synthetic plastic material or the like.

As can be seen in FIGS. 1 and 3, the surfaces 16*a*, 16*b* of the holders 13*a*, 13*b* attract one side of the web 1 and one side of each section 32 in the vertical path between the station 25 and the path portion (station A) where the sections 32 are expelled from the apparatus, e.g., by successive commodities which are to be wrapped in a manner not forming part of the present invention. Both sides of the web 1 and both sides of each section 32 can be guided by stationary guide means in the form of strips or rails 34*a*, 34*b* and 36*a*, 36*b* which are mounted in or on the housing H between the stations 25 and A.

The sections 32 which reach the station A are expelled or otherwise removed from the path for the web 1 by moving in the direction which is indicated by the arrow 37, i.e., transversely of the direction which is indicated by the arrow 33. The suction ports 17*a*, 17*b* are sealed from the suction generating device not later than at the station A. This enables a pusher (not shown) or a block-shaped commodity (not shown) to advance the lowermost section 32 in the direction of the arrow 37 by moving against the right-hand side of the section 32 at the station A. The pusher or the commodity can cooperate with one or more fixed or movable folding members 40 which cause selected portions of the lowermost section 32 to be folded around the pusher or around the respective commodity in a highly predictable manner so that a portion of the wrapping operation (if the sections 32 are expelled by successive commodities which require wrapping) is completed in automatic response to expulsion of sections 32 from the predetermined path (arrow 33) into a different path (arrow 37). A pusher or the like can be used to move successive commodities (e.g., stacks of stationery products, cigarette packs or the like) in the direction which is indicated by the arrow 37.

The pusher or successive commodities can remove successive sections 32 from their path with a high degree of accuracy and predictability. This is due to the fact that the area of each surface 16*a*, 16*b* is preferably a small fraction (preferably much less than 10 percent) of the area of the one or the other side of a section 32. Furthermore, the length of a surface 16*a* or 16*b*, again as considered in the direction of the arrow 33) is preferably a minute fraction (e.g., much less than 10 percent) of the length of a section 32. The utilization of holders 13*a*, 13*b* with relatively small surfaces 16*a*, 16*b* is desirable on the ground that, when the respective ports 17*a*, 17*b* are sealed from the suction generating device, attraction between the surfaces 16*a*, 16*b* and the respective side of the section 32 at the station A is terminated instantaneously so that the orientation of the section 32 does not change in an unpredictable manner while the section is being moved in the direction of arrow 37. In other words, the force with which the holders 13*a*, 13*b* at the station A attract a section 32 is abruptly reduced from a value which is sufficent to predictably transport the section 32 in the direction of the arrow 33 to zero so that the holders which have arrived at the station A do not offer any or merely offer a negligible resistance to expulsion of the section in the direction of the arrow 37.

FIG. 1 further shows channels 38*a*, 38*b* which serve to connect the suction generating device (e.g., a fan) with the channels 21*a*, 21*b* in the conveyors 14*a*, 14*b*, and the apparatus further comprises means (e.g., nozzles) 39*a*, 39*b* for connecting the ports 17*a*, 17*b* with a source of compressed air as soon as the corresponding holders 13*a*, 13*b* arrive at the station A so that the jets of compressed air act in the direction of arrow 37 and assist the pusher or a commodity in removing the section 32 from the station A with a very high degree of predictability. The nozzles 39*a*, 39*b* for supplying jets of compressed air (or another suitable gaseous fluid) are optional but desirable and advantageous when the material of the web 1 is such that even slight adherence of sections 32 to the surfaces 16*a*, 16*b* of the holders 13*a*, 13*b* at the station A could interfere with predictable removal of such sections from the apparatus. If the nozzles 39*a*, 39*b* are provided or are being used, expulsion of successive sections 32 at the station A begins when selected portions of the lowermost section 32 reach predetermined positions with reference to the paths for jets of compressed gaseous fluid. The manner of synchronizing the operation of valves or like devices which regulate the admission of compressed gaseous fluid into the nozzles 39*a*, 39*b* with the operation of the conveyors 14*a*, 14*b* which transport the holders 13*a*, 13*b* and hence the sections 32 from the station 25 to the station A forms no part of the present invention.

FIG. 1 further shows a locking bolt 41 which can be disengaged to allow for pivoting of the left-hand part 42 of the housing H from the illustrated operative position in order to facilitate convenient threading of the leader of the web 1 into the nips of the rollers 3*a*, 3*b* as well as into the nip of the web advancing wheels 6*a*, 6*b*. The part 42 of the housing H is pivotable about the axis of a horizontal fulcrum 43.

The apparatus which is shown in FIGS. 1 to 3 is operated as follows:

The drive for the web advancing wheel 6*b* is set in motion so that the wheels 6*a*, 6*b* cooperate to continuously move the web 1 longitudinally along a substantially vertical path. The orbiting knife 4 makes at least one slit in spaced-apart portions of the running web 1, preferably at intervals which are selected with a view to ensure that each section 32 is formed with a slit. The pulleys 22 and 23 are mounted in such a way that the conveyors 14*a*, 14*b* have vertical stretches or reaches which are adjacent to the right-hand side of the path for the web 1, and such stretches begin at a level below the web advancing wheels 6*a*, 6*b* but above the severing station 25. The surfaces 16*a*, 16*b* of successive pairs of holders 13*a*, 13*b* which form part of the improved retaining means come into contact with the right-hand side of the web 1 (as viewed in FIG. 1) at a level between the wheels 6*a*, 6*b* and the station 25, and the suction ports 17*a*, 17*b* of such holders are then in communication with the suction generating device (via channels 18*a*, 18*b*, 21*a*, 21*b*, 38*a*, 38*b*) so that the holders attract the adjacent portion of the right-hand side of the web and ensure that the web advances in a highly predictable fashion so that it can be severed at preselected intervals. As can be seen in FIG. 3, the holders 13*a*, 13*b* merely engage the adjacent longitudinally extending marginal portions of the web 1 and thereafter the corresponding longitudinally extending marginal portions (32*a*, 32*b*) of the sections 32. The (subatmospheric) pressure in the suction ports 17*a*, 17*b* which advance along the path for the web 1 and sections 32 can be regulated so that the web and the sections are attracted to the surfaces 16*a*, 16*b* with an optimum force.

The cutter 26 severs the web 1 when the holders 13*a*, 13*b* which move downwardly from the pulley 22 toward the counterknife 27 are closely or immediately adjacent to but are still located above the severing plane. The holders 13*a*, 13*b* continue to move downwardly at the speed of the web 1 and advance toward the station A. These holders first move with a portion of the leader of the web 1 which is spaced apart from the lowermost end of the leader but they do engage the leader or lowermost end of the section 32 as soon as the latter is formed, i.e., as soon as the cutter 26 has completed a full revolution starting from the position which is shown in FIG. 1 and in which the cutter 26 is in the process of severing the web 1. If the nozzles 39*a*, 39*b* for supplying jets of compressed gaseous fluid are in use, expulsion of a freshly formed section 32 from the vertical path (arrow 33) begins as soon as selected portions of such section reach the outlets of the nozzles 39*a*, 39*b* so that the section can be expelled in a highly predictable manner. The suction ports 17*a*, 17*b* of the holders 13*a*, 13*b* at the station A are then sealed from the suction generating device, i.e., from the channels 38*a*, 38*b*. As mentioned above, the section 32 which is in the process of advancing in the direction of the arrow 37 can be folded by one or more stationary or mobile folding instrumentalities 40 cooperating with the aforementioned pusher or with a commodity which is caused to move across the path of the web 1 and sections 32 in the direction of the arrow 37.

Figure 4:
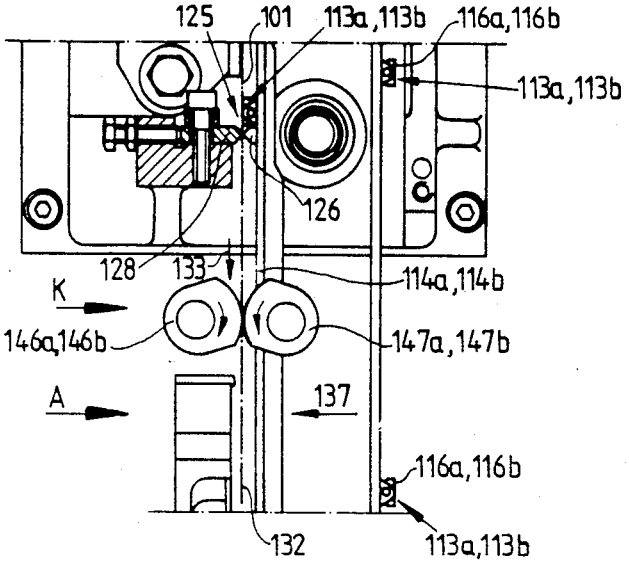
FIG. 4 is a partly elevational and partly sectional view of a portion of a modified apparatus with two retaining means.

In the apparatus of FIG. 4, the guides 34*a*, 34*b* and 36*a*, 36*b* of the first apparatus are replaced with clamping members which engage the sections 132 and advance with them from the first toward the second portion of the path for the web 101. All such parts of the apparatus of FIG. 4 which are identical with or clearly analogous to the corresponding parts of the first apparatus are denoted by similar reference characters plus 100. The clamping members are automatically disengaged from the respective sections 132 when they reach the station A.

The clamping members include a pair of disc cams 146*a*, 146*b* at one side and a pair of disc cams 147*a*, 147*b* at the other side of the path for the web 101 and sections 132 downstream of the severing station 125. The cams 146*b* and 147*b* are located behind the plane of FIG. 4, and all of these cams are located (at a clamping station K) at the level of the guides 34*a*, 34*b* and 36*a*, 36*b* of FIG. 1, i.e., at a level below the severing station 125 but above the station A. They are rotated in synchronism with the movement of the holders 113*a*, 113*b* along the path which is defined by the conveyors 114*a*, 114*b* so that their lobes engage the respective sides of the web 101 and sections 132 during advancement of a section 132 toward the station A and the lobes release the trailing end of a section 132 at the exact moment when the section is ready to be transferred from the vertical path (arrow 133) into the path which is denoted by the arrow 137. At such times, the leader of the section 132 at the station A is adjacent to the surfaces 116*a*, 116*b* of the neighboring holders 113*a*, 113*b*.

The clamping members or cams 146*a*, 146*b* and 147*a*, 147*b* can be said to constitute a second retaining means which engages and properly locates one side of the section 132 (actually both sides) while the other side of the section is attracted by the surfaces 116*a*, 116*b* of the corresponding holders 113*a*, 113*b*. It has been found that guides or second retaining means in the form of cams even further enhance the accuracy with which successive sections 132 can be transported from the station 125 to the station A by the simple expedient of properly selecting the dimensions of the lobes of the cams and their angular velocity with reference to the linear speed of the holders 113*a*, 113*b* in the direction of the arrow 133.

Figure 5:
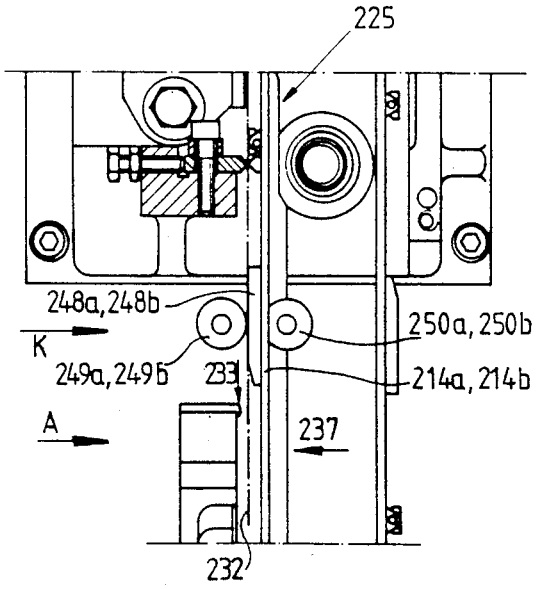
FIG. 5 is a view similar to that of FIG. 4 but showing modified second retaining means.

The apparatus which is shown in FIG. 5 constitutes a modification of the apparatus of FIG. 4. All such parts of this apparatus which are identical with or analogous to the corresponding parts of the first apparatus are denoted by similar reference characters plus 200. The second retaining means including the clamping members or cams 146*a*, 146*b* and 147*a*, 147*b* of FIG. 4 is replaced by a second retaining means including elongated posts or studs 248*a*, 248*b* which are secured to the respective conveyors 214*a*, 214*b*. When the posts reach the clamping station K at a level below the severing station 225, they cooperate with idler rollers 249*a*, 249*b* and 250*a*, 250*b* in a manner as shown in FIG. 5, i.e., the posts 248*a*, 248*b* are backed up by the respective idler rollers 250*a*, 250*b* to bear against the right-hand side of the section 232 and they urge the left-hand side of such section against the respective idler rollers 249*a*, 249*b*. The posts 248*a*, 248*b* engage the respective marginal portions of the section 232 in a manner which is analogous to that of engagement between the marginal portions of the section 32 and holders 13*a*, 13*b* shown in FIG. 3. The posts 248*a*, 248*b* advance with the conveyors 214*a*, 214*b* and their trailing ends move beyond the gap between the rollers 249*a*, 249*b* and 250*a*, 250*b* when the corresponding section 232 reaches the station A and is ready to be expelled in the direction which is indicated by the arrow 237.

The utilization of holders 13*a*, 13*b* or 113*a*, 113*b* or 213*a*, 213*b* whose web-engaging surfaces (such as 16*a*, 16*b*) are small or very small (as compared with the areas of the respective sides of the sections 32, 132 and 232) is desirable and advantageous irrespective of whether or not such surfaces are provided with suction ports because the relatively small surfaces of the holders can be simultaneously (symmetrically) separated from the respective side of a section at an optimum time for transfer of the section from the path for the web 1, 101 or 201 without any, even minute, changes in orientation of the section. Of course, the utilization of holders with relatively small section- and web-contacting surfaces is particularly desirable if the holders are provided with ports (such as 17*a*, 17*b*) which enable the holders to attract a sheet by suction during transport of the sheet from the severing station to the station A. Suction between a sheet and the adjacent holders can be terminated practically instantaneously (i.e., in immediate response to sealing of the suction ports from the suction generating device) if the areas of the surfaces on the holders are small or very small. On the other hand, even such small surfaces enable the holders to reliably advance and hold a section during travel toward the station A until the very last moment when the transferring means (such as a pusher, a commodity to be wrapped and/or the aforediscussed nozzles 39*a*, 39*b*) is ready to expel the section from the path which is denoted by the arrow 33, 133 or 233. At any rate, the operation of the retaining means including the improved holders is much more reliable than the operation of endless belt conveyors, even if the conveyors are provided with suction ports to directly attract a section during travel between the severing station and the next processing station (such as the station A). As mentioned above, the length of the holders (as considered in the direction of advancement of the web) can be less than 10 percent of the length of a section 32, 132 or 232; for example, the length of a holder can approximate five percent of the length of a section.

The endless belt conveyors 14*a*, 14*b* of FIG. 1 and the corresponding conveyors of FIGS. 4 and 5 can be replaced with endless chain conveyors without departing from the spirit of the invention. In either event, the conveyors are preferably formed with surfaces (see the surfaces 14*a*', 14*b*' in FIG. 2*a*) which are parallel to the surfaces (such as 16*a*, 16*b*) of the holders thereon. The utilization of endless toothed belt conveyors or chain conveyors is preferred at this time because their movements can be more accurately synchronized with the continuous movement of the web 1, 101 or 201 to thus ensure that two holders are invariably located immediately behind the severing plane when the tool of the cross cutter severs the web.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. Apparatus for converting a running web into a series of discrete sections, comprising means for advancing the web longitudinally in a predetermined direction and along a predetermined path; means for severing the web at selected intervals in a first portion of said path, so that the web yields said series of discrete sections each having two sides of predetermined area, including at least one cutter which is operative to sever the web transversely of said direction in a predetermined plane; means for retaining the web and the sections in said path, including at least one holder having a contact surface whose area is a small fraction of said predetermined area and which engages the web only close to and upstream of said plane, as considered in said direction, when the web is severed by said cutter; and conveyor means for transporting said holder in said direction adjacent to said path so that the holder first advances the web toward said plane and thereupon advances the freshly severed section from said first portion into a second portion of said path.

2. The apparatus of claim 1, wherein said cutter is arranged to subdivide the web into sections each of which has a predetermined length, as considered in said direction, the length of said surface as considered in said direction being less than ten percent of said predetermined length.

3. The apparatus of claim 1, wherein said holder includes means for attracting the web and the sections by suction.

4. The apparatus of claim 1, further comprising means for separating the holder from the adjacent section in the second portion of said path.

5. The apparatus of claim 4, wherein said separating means includes means for directing at least one jet of compressed gaseous fluid against the section in the second portion of said path in a direction to separate the section from said surface.

6. The apparatus of claim 1, wherein said conveyor means defines for said retaining means a second path having a stretch which is adjacent to said predetermined path from a first location at least slightly upstream of said first portion to a second location at or downstream of the second portion of said predetermined path.

7. The apparatus of claim 6, wherein said stretch of said second path is adjacent to one side of said predetermined path so that said surface of said holder can engage one side of the web and the corresponding side of the section which is advanced thereby from the first toward the second portion of said predetermined path.

8. The apparatus of claim 7 for converting a web having elongated first and second marginal portions, wherein said retaining means includes first and second holders which engage the respective marginal portions of the web.

9. The apparatus of claim 6, wherein said conveyor means includes an endless flexible conveyor.

10. The apparatus of claim 9, wherein said conveyor has a surface which faces toward said retaining means and is parallel to the surface of said holder.

11. The apparatus of claim 1, further comprising guide means for portions of successive sections between the first and second portions of said path.

12. The apparatus of claim 11, wherein said conveyor means includes means for advancing said retainer means past said guide means.

13. The apparatus of claim 1, wherein said holder is arranged to contact one side of the web and of a section in said path, and further comprising second retaining means for holding at least the other side of each section between said portions of said path.

14. The apparatus of claim 13, wherein said second retaining means comprises at least one pair of cooperating clamping members disposed at the opposite sides of the section which advances from the first to the second portion of said path.

15. The apparatus of claim 1, further comprising means for removing successive sections from the second portion of said path, including means for moving successive sections transversely of said direction.

16. The apparatus of claim 1, wherein said predetermined path is at least substantially vertical.

17. The apparatus of claim 1, wherein said retaining means comprises several pairs of equidistant holders.

18. The apparatus of claim 1, further comprising stationary guide means for the web and for the sections in said predetermined path, said retaining means including pairs of holders and said guide means being disposed between those pairs of holders which are adjacent to said predetermined path.

19. A method of converting a running web into a series of discrete sections, comprising the steps of advancing the web longitudinally in a predetermined direction and along a predetermined path; severing the web at selected intervals in a first portion of said path so that the web yields said series of discrete sections each having two sides, said severing step including cutting across the web in a predetermined plane; retaining the web and said sections in said path, including mechanically contacting and holding one side of the web only in close proximity to and upstream of said plane in the course of each severing step, the area of mechanical contact with the one side of the web in the course of each severing step being a minute fraction of the area of one side of a section; and expelling successive sections from a second portion of said path.

20. The method of claim 19, wherein said retaining step includes attracting the web and the sections by suction so that the sections are held against unintended changes of orientation all the way during travel from said first to said second portion of said path.

* * * * *